United States Patent [19]

Synek et al.

[11] Patent Number: 4,494,466

[45] Date of Patent: Jan. 22, 1985

[54] TABLE WITH A MECHANISM FOR AUTOMATICALLY VARYING THE SIZE OF THE TABLETOP

[76] Inventors: Ervin H. Synek, 346 N. Justine Ave., Chicago, Ill. 60607; David Volejnicek, 4735 W. Beaubien Blvd., Lisle, Ill. 60532

[21] Appl. No.: 343,547

[22] Filed: Jan. 28, 1982

[51] Int. Cl.[3] ..... A47B 1/03

[52] U.S. Cl. ..... 108/85; 108/84; 108/86; 108/87

[58] Field of Search ..... 108/84, 83, 85, 86, 108/87, 20, 89, 90

[56] References Cited

U.S. PATENT DOCUMENTS

| | | | |
|---|---|---|---|
| 1,035,214 | 8/1912 | McGall | 108/85 |
| 1,888,124 | 11/1932 | Pulaski | 108/85 |
| 1,915,347 | 6/1933 | Wurm | 108/84 |
| 2,007,475 | 7/1935 | Miller | 108/84 |
| 3,294,042 | 12/1966 | Charne et al. | 108/84 |
| 4,114,541 | 9/1978 | Weddendorf | 108/20 |

*Primary Examiner*—Francis K. Zugel
*Assistant Examiner*—Mark W. Binder
*Attorney, Agent, or Firm*—David Volejnicek

[57] ABSTRACT

A table (20) comprises a pair of side leaves (22,23) movable with respect to each other to abut each other for forming a small tabletop (27), a center leaf (24) selectively interposable between the pair of side leaves (22,23) for forming a large tabletop (37), and a moving mechanism (25) for selectively automatically configuring the leaves (22,23,24) into a small or a large tabletop (27,37). The moving mechanism (25) includes an apparatus (40) for sliding the side leaves (22,23) toward and away from each other, a cam apparatus (41) for raising and lowering the center leaf (24) and for storing the center leaf (24) below the side leaves (22,23) and for retrieving the center leaf (24) from storage, and a driving apparatus (88) for moving the slide apparatus (40) and the cam apparatus (41).

10 Claims, 12 Drawing Figures

TABLE WITH A MECHANISM FOR AUTOMATICALLY VARYING THE SIZE OF THE TABLETOP

BACKGROUND OF THE INVENTION

This invention relates to tables having tabletops of variable size.

Various applications of tables make it desirable that the tabletop be variable in size. For example, a dining room table may occasionally be required to provide a seating capacity that exceeds the seating capacity which is usually required, yet space constraints make it impractical to use a table which permanently has the greater seating capacity; hence, a table having a variable seating capacity is called for.

Presently, the needs of such applications are met primarily with tables having tabletops of variable size that require manual manipulation of the tables' parts to achieve the size adjustment. Such a table generally has two sliding side leaves that fit alongside each other to form a tabletop of a smaller size, and that slide apart to admit between them one or more removable center leaves to form a tabeltop of a larger size.

The process of moving the various tabletop components apart, inserting or removing one or more center leaves, carrying the removable center leaves from and to storage, properly aligning the various leaves with each other, and fitting the components together again, is a physically demanding task that requires some degree of physical dexterity and exertion and that often causes aggravation. Furthermore, manual handling of the various portions of the table during this process often causes damage to the table.

Therefore, a better solution to the problem of tabletop size adjustment is called for.

SUMMARY OF THE INVENTION

This invention is directed to solving these and other disadvantages of the prior art tables of adjustable size.

According to this invention, a table having a tabletop variable in size includes means for selectively automatically varying the size of the tabletop. In particular, the table comprises a tabletop having a plurality of leaves, selectively configurable to vary the size of the tabletop, and moving means for automatically configuring the plurality of leaves into a tabletop of a selected size. Preferably, a table of this invention comprises a plurality of first leaves movable with respect to each other and abutting each other to form a tabletop of a first size, at least one second leaf selectively interposable between the plurality of first leaves to form therewith a tabletop of at least one second size, and a moving mechanism for automatically selectively configuring the first and second leaves into the tabletops of the first and the at least one second size. Most preferably, the table utilizes two first leaves and one second leaf and can be automatically configured into two sizes.

Because of table of the present invention is configured by an automatic mechanism and not by manual manipulation, there is eliminated the physical effort, reqirements of dexterity, and the aggravation that accompany the manual task. And because the various portions of the table are no longer subjected to manual handling during reconfiguration, they are much less subject to being damaged.

These and other advantages of the present invention will become apparent from the consideration of the following description of the preferred embodiment of the invention taken in conjunction with the drawing.

DETAILED DESCRIPTION OF A PREFERRED EMBODIMENT

Figure 1:
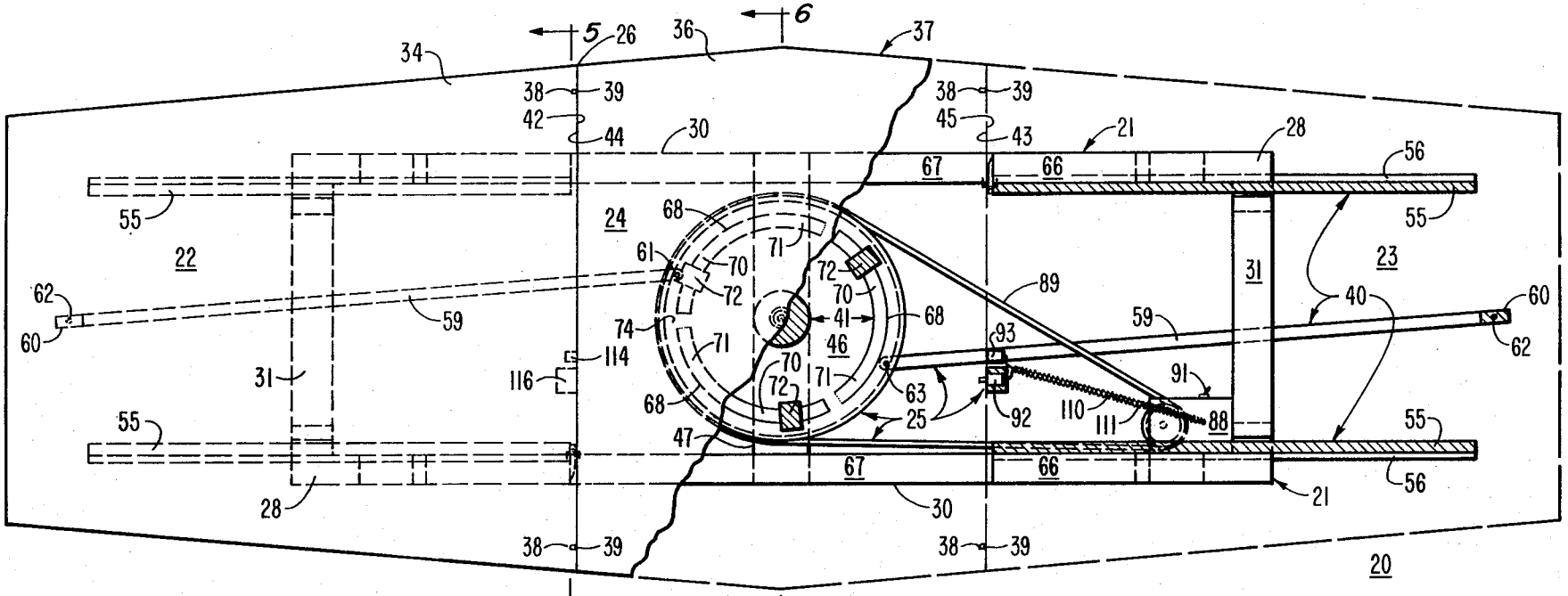
FIG. 1 is a cutaway top view of a table illustrative of the invention, in the unfolded position.
Figure 2:
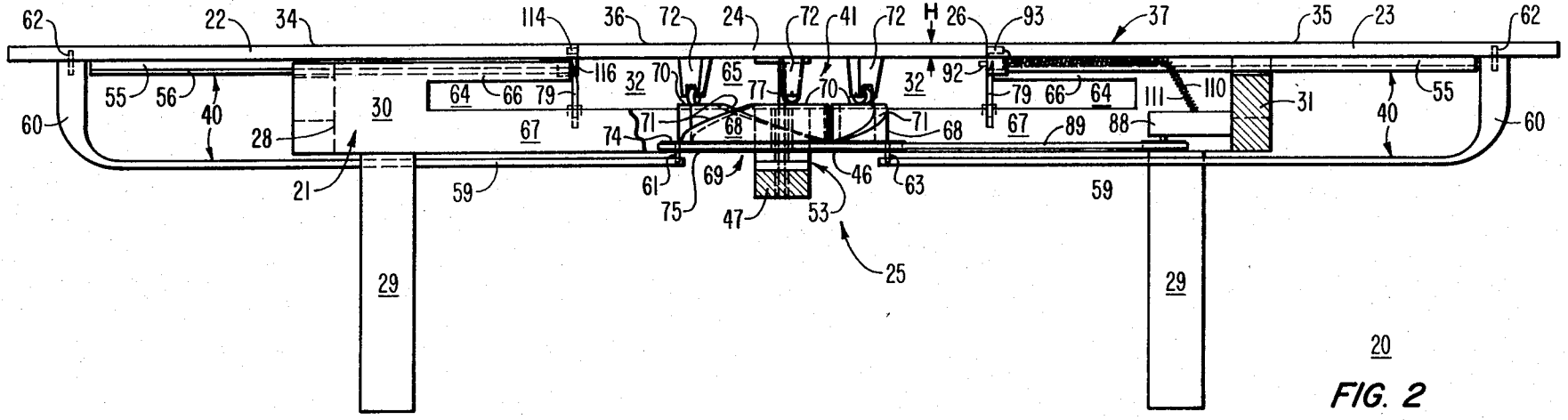
FIG. 2 is a side cutaway view of the unfolded table.

Turning now to the drawing, there is shown in FIGS. 1 and 2 a top and a side cutaway view, respectively, of a table 20 which includes a preferred embodiment of this invention. The table 20 is comprised of a body 21, a first and a second side leaf 22 and 23, respectively, movably positioned over the body 21, a center leaf 24 interposable between the side leaves 22,23, and an electromechanical mechanism 25 positioned below the surface of the table 20 for reconfiguring the leaves 22, 23, and 24 into a tabletop of various sizes.

Figure 3:
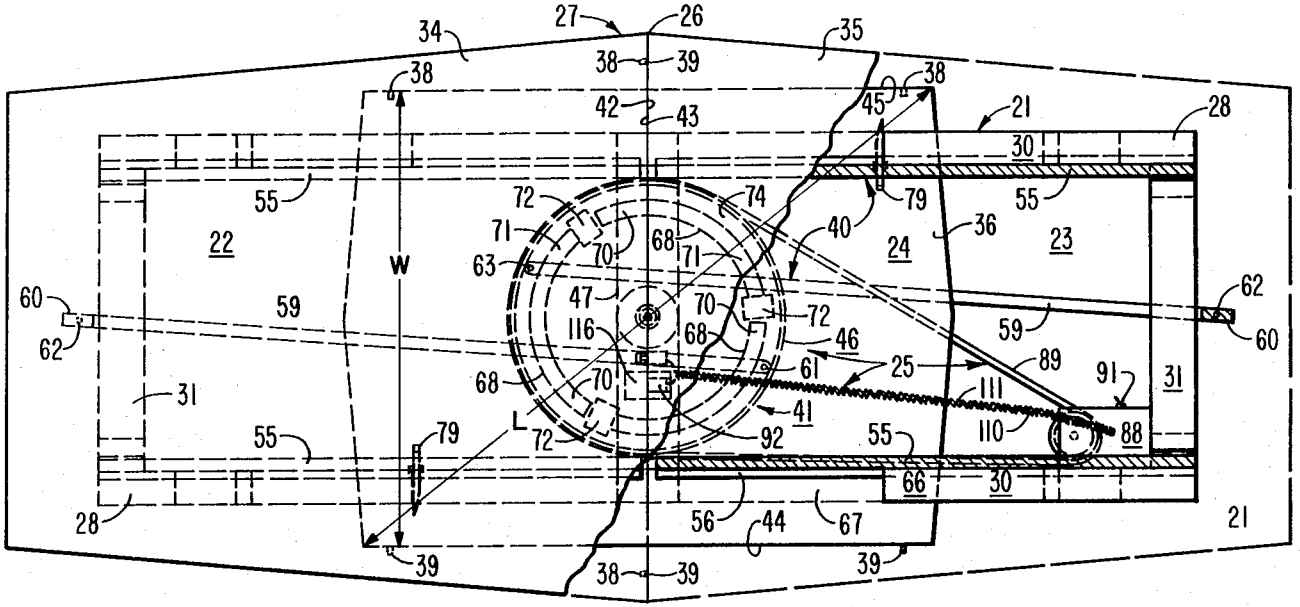
FIG. 3 is a top cutaway view of the table in the folded position.
Figure 4:
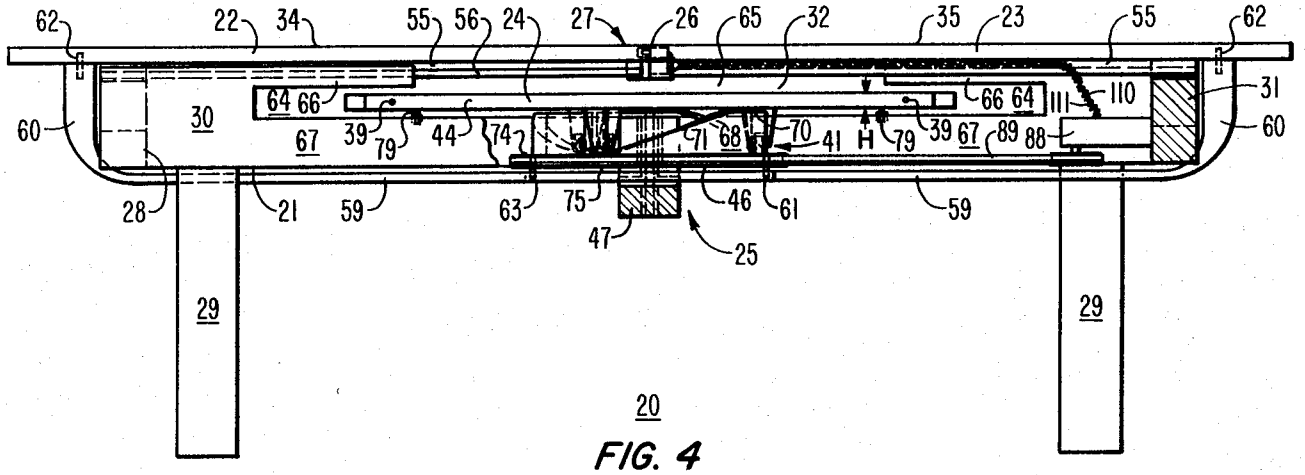
FIG. 4 is a side view of the folded table.

The table 20 is shown in FIGS. 1 and 2 in the open, or unfolded, configuration, with the center leaf 24 interposed between the side leaves 22, 23 to form therewith a large tabletop 37. This is in contrast to FIGS. 3 and 4, which show the table 20 in the closed, or folded, configuration, with the side leaves 22, 23 abutting each other to form a small tabletop 27, and the center leaf 24 positioned in storage below the side leaves 22, 23. FIGS. 3 and 4 also show the center leaf 24 as having a width W, a thickness or height H, and a diagonal diameter or length L.

The table body 21 includes a rectangular rigid frame 28 horizontally reposing on and rigidly attached to four legs 29, which are symmetrically arranged about the lower periphery of the frame 28 and extend downwardly therefrom. The frame 28 includes two horizontal beam-like parallel face members 30 whose end portions are spanned by two beam-like side members 31.

Each of the face members 30 defines a slot 32 which extends horizontally completely through the face member 30, runs substantially the length of the face member 30, and opens outwardly along a top portion thereof. The slot 32 is symmetrical with respect to an axis extending vertically through the midpoint of the face member 30. The slot 32 has the shape of an inverted "T". Those portions of the slot 32 which define the arms of the inverted "T" are designated by the numeral 64, and that portion of the slot 32 which defines the leg of the inverted "T" is designated by the numeral 65. The dimensions of the slot 32 are such that the width of the leg 65 is greater than the width W of the center leaf 24, the span of the arms 64 is approximately equal to the diagonal length L of the center leaf 24, and the thickness of the arms 64 is greater than the height H of the center leaf 24. The face member 30 defines an upwardly-facing "C" shape about the slot 32: those portions of the face member 30 which define the claws of the "C" are designated by the numeral 66, and the body portion of the "C" which connects the claws 66 is designated by the numeral 67.

The leaves 22–24 are horizontal planar rigid members. The side leaves 22, 23 are substantially images of each other. As FIGS. 3 and 4 show, the leaves 22 and 23 have side edges 42, 43, respectively, which mate each other when in abutment. In abutment, top surfaces 34, 35 of the side leaves 22, 23, respectively, form a contiguous surface 26 of the small tabletop 27.

The center leaf 24 is sized and shaped such that, when it is interposed between the side leaves 22 and 23, its top surface 36 forms with the top surfaces 34, 35 of the side leaves 22, 23, respectively, a contiguous surface 26 of the large tabletop 37 (see FIG. 1), but when it is positioned below the side leaves 22, 23, the side leaf 24 does not extend outwardly from under the side leaves 22, 23 (see FIG. 3). The center leaf 24 has side edges 44,45 which mate with the side edges 42, 43, respectively, of the leaves 22,23 when in abutment with them (see FIG. 1).

The side edge 43 of the leaf 23 has a pair of nipples 39 extending horizontally outwardly therefrom, as does the side edge 44 of the center leaf 24. In the configuration of FIG. 3, the nipples 39 of the leaf 23 mate with or engage a pair of orifices 38 defined by the side edge 42 of the leaf 22, to lock the leaf 23 to the leaf 22. In the configuration of FIG. 1, the nipples 39 of the leaf 23 mate with a pair of orifices 38 defined by the side edge 45 of the center leaf 24, and the nipples 39 of the center leaf 24 mate with the pair of orifices 38 of the leaf 22 to lock the leaf 22 to the leaf 24 and the leaf 24 to the leaf 23.

The mechanism 25 is positioned below the tabletop 27 or 37. In FIGS. 1 and 3, portions of the tabletops 27 and 37 have been cut away, and in FIGS. 2 and 4, portions of the frame 28 have been cut away, to reveal more clearly the structure of the mechanism 25. The mechanism 25 includes a slide apparatus 40 for moving the two side leaves 22, 23, and a cam apparatus 41 for moving the center leaf 24.

The mechanism 25 is centered around a pulley 46 which is horizontally rotatably mounted at the center of the frame 28. The diameter of the pulley 46 is greater than one half the width W of the center leaf 24. The pulley 46 is mounted on a support beam 47 which spans the face members 30 of the frame 28 in parallel with the side members 31 and is mounted to the underside of the members 30.

Figure 6:
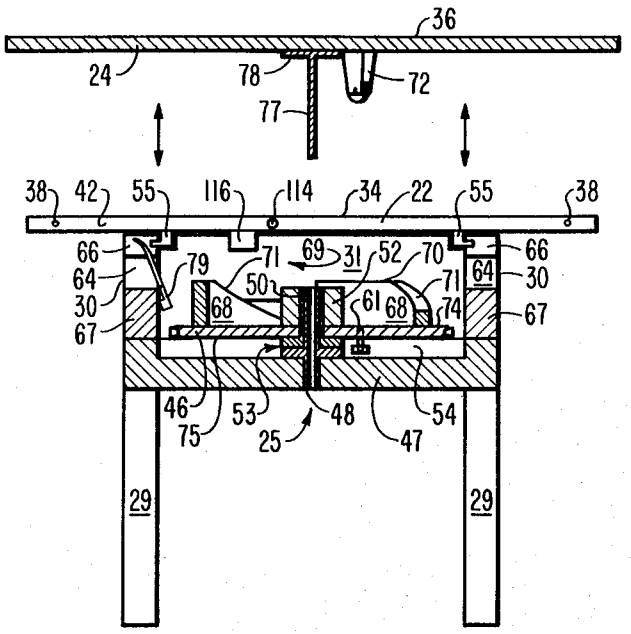
FIG. 6 is a sectional exploded view of the unfolded table taken along the line 6—6 of FIG. 1.
Figure 10:
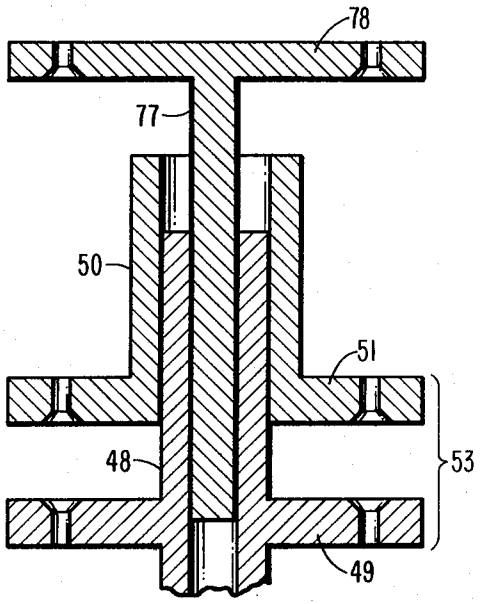
FIG. 10 is a partially exploded detail sectional view of the rotary axes shown in FIG. 6.

The mounting of the pulley 46 is best shown in FIG. 6, taken in conjunction with FIG. 10 which shows the rotary axes of FIG. 6 on a larger scale. The support beam 47 has a hollow shaft 48 vertically mounted therein and extending upwardly therefrom. The shaft 48 has a horizontally outwardly extending flange 49 which is attached, for example by being screwed, to the upper surface of the beam 47 to mount the shaft 48 thereto.

In turn, the pulley 46 has a hollow shaft 50 mounted at its center and extending upwardly therefrom. The shaft 50 has a horizontally outwardly extending flange 51 at one end which is attached, for example by being screwed to the bottom or lower surface 75 of the pulley 46, and the shaft 50 extends through the center of the pulley 46 to rise above its top surface 74. On the top surface 74 the pulley 46 has a block 52 mounted about the shaft 50, which block 52 helps to mount the shaft 50 more rigidly to the pulley 46.

The shaft 48 fits inside the hollow shaft 50 to provide an axis about which the shaft 50 with the pulley 46 can rotate. The flange 51 seats on top of the flange 49 and together they form a spacer 53 which separates the support beam 47 from the pulley 46. Beyond the horizontal extent of the spacer 53 the beam 47 and the pulley 46 define between them a space 54.

Figure 5:
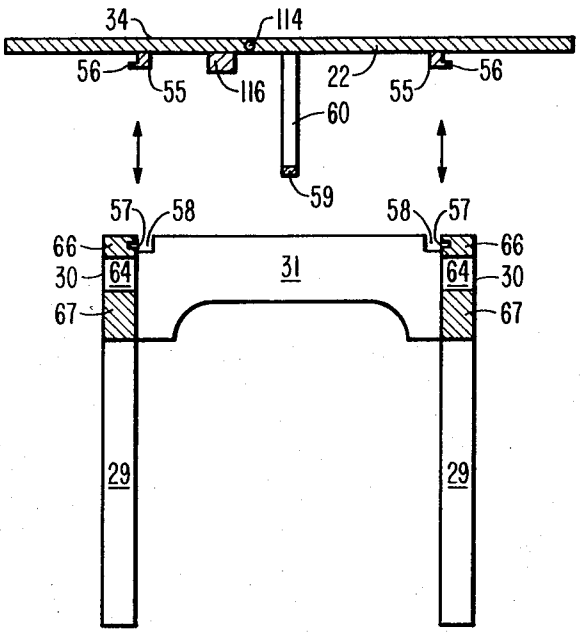
FIG. 5 is a sectional exploded view of the unfolded table, taken along the line 5—5 of FIG. 1.

The side leaves 22, 23 are movably mounted to the frame 28 to slide along the length thereof toward and away from each other. The mounting of the side leaves 22,23 is best shown in FIG. 5. The leaves 22 and 23 are both mounted in the same manner and therefore FIG. 5 is representative of both, though it shows only the mounting of the leaf 22.

The leaf 22 has a pair of runners 55 mounted to its underside. The runners 55 are elongated straight members "L"-shaped in cross-section and positioned perpendicularly with respect to the side edge 42. The "L"-shaped runners 55 define feet 56 that extend horizontally outwardly away from each other.

Each face member 30 defines along the upper portion of its inner surface a channel 57 adapted to receive a foot 56 for sliding therein. The channels 57 run the length of the face members 30, interrupted only by the legs 65 of the slots 32.

Each side member 31 of the frame 28 defines at its upper corners adjacent to the face members 30 notches 58 that permit the runners 55 to slide into and out of the frame 28. Thus, the side leaves 22, 23 can slide on the runners 55 along the length of the frame 28 by being pushed or pulled.

Referring to FIGS. 1–4, each leaf 22, 23 is pushed and pulled by an arm 59, which is connected at one end to the leaf 22, 23 via a curved shoulder 60 and which extends horizontally beneath the frame 28 to the pulley 46, where it is mounted to the outer periphery of the underside 75 of the pulley 46 (also see FIG. 6). The arm 59 of the leaf 22 is mounted to the pulley 46 by a pin 61, while the arm 59 of the leaf 23 is mounted to the pulley 46 by a pin 63 located diametrically opposite the pin 61 on the pulley 46. Each shoulder 60 is mounted to the underside of the leaf 22, 23 by a pin 62 at a location lying midpoint between the runners 55 and outside of the frame 28 when the table 20 is in the closed configuration of FIGS. 3 and 4. Each pin 61, 62, 63 allows the associated arm 59 to rotate in the horizontal plane.

As FIGS. 3 and 4 show, end portions of the arms 59 which are attached to the pulley 46 are sized and shaped to pass through the space 54 between the pulley 46 and the support beam 47. The length of the arms 59 is such as to allow the center leaf 24 to be interposed between the two side leaves 22, 23 in the table configuration of FIGS. 1 and 2, and to allow the edges 42, 43 of the side leaves 22, 23, respectively, to abut each other in the table configuration of FIGS. 3 and 4.

Thus, when the orientation of the arms 59 and the pulley 46 is substantially as shown in FIGS. 1 and 2, rotation of the pulley 46 soon pulls the arms 59 toward the support beam 47, and the arms 59 in turn pull on the side leaves 22, 23, causing them to slide toward each other. When the orientation of the arms 59 and the pulley 46 is substantially as shown in FIGS. 3 and 4, rotation (clockwise) of the pulley 46 pushes the arms 59 away from the support beam 47, and the arms 59 in turn push on the side leaves 22, 23, causing them to slide away from each other.

The center leaf 24 is movably mounted over the pulley 46 to rise and fall with respect to the pulley 46, and to rotate with the pulley 46 when in the fallen position.

As best shown in FIGS. 2 and 6, the upper surface 74 of the pulley 46 defines three identical inclined planes 68 which substantially form a cam 69. The three inclined planes 68 are symmetrically arranged along the upper periphery of the pulley 46. Each inclined plane 68 is curved to define in the horizontal plane an arc about the center of the pulley 46. At its peak each inclined plane 68 defines a flat horizontal surface or track 70 which is joined to the upper surface 74 of the pulley 46 by an inclined surface or track 71, also defined by the inclined plane 68.

Figure 9:
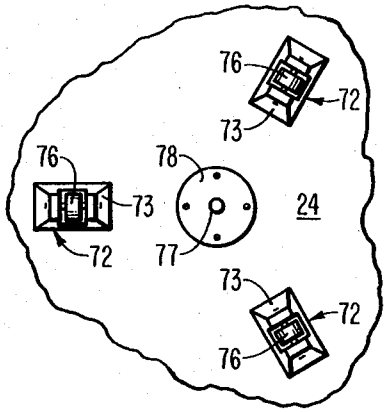
FIG. 9 is a detail view of the rollers of the table.

In turn, the center leaf 24 has three rollers 72 which are adapted to ride on the inclined planes 68 when the center leaf 24 lies centered over the pulley 46. Each roller 72 has a roller wheel 76 which is mounted in a roller mount 73, as shown in detail in FIG. 9, and the mount 73 is rigidly attached to the underside of the center leaf 24. When the center leaf 24 lies centered over the cam 69 (see FIG. 6), the rollers 72 are arranged such that the roller wheels 76 lie symmetrically spaced along the periphery of, and tangent to, the circle of the arcs defined by the inclined planes 68.

The relative height of the inclined planes 68 is just slightly less than the height of the rollers 72 and such that the surface 36 of the center leaf 24 lies in the plane of the surfaces 34,35 of the side leaves 22,23 when the roller wheels 76 repose on the tracks 70, as shown in FIG. 2.

The relative position of the rollers 72, the inclined planes 68, and the pins 61, 62 of the arms 59 is such that the rollers 72 ride the tracks 70 in the table configuration of FIGS. 1 and 2 and such that the rollers 72 ride the top surface 74 of the pulley 46 in the table configuration of FIGS. 3 and 4.

To keep itself centered over the pulley 46, and to keep the roller wheels 76 on the tracks 70, 71, the center leaf 24 has extending vertically downwardly therefrom (see FIG. 6) a shaft 77 which extends into, and movably rides in, the hollow shaft 48 of the support beam 47, as shown in detail in FIG. 10.

The shaft 77 has a flange 78 that is utilized to rigidly attach the shaft 77 to the bottom surface of the center leaf 24.

As the pulley 46 rotates counterclockwise from its position shown in FIGS. 1 and 2, each roller wheel 76 rides from the track 70 onto the track 71 and down the track 71 to the top surface 74 of the pulley 46 to bring the center leaf 24 down into the slot 32; when the rotation of the pulley 46 is reversed, the center leaf 24 rides the cam 69 back up again.

When the roller wheels 76 reach the top surface 74 of the pulley 46 as the pulley is rotating counterclockwise, the descent of the center leaf 24 stops, motion of the center leaf 24 relative to the pulley 46 ceases, and the center leaf 24 begins to rotate with the pulley 46 within the slot 32. The length of the inclined track 71 of the inclined plane 68 is such that the center leaf 24 is caused to rotate with the pulley 46 through an angle of 90 degrees before the table reaches the configuration of FIGS. 3 and 4.

If the table 20 is in the configuration of FIGS. 3 and 4 and the rotation of the pulley 46 is in the clockwise direction, the center leaf 24 rotates with the pulley 46 through an angle of 90 degrees. At that point the center leaf 24 stops rotating and begins to rise, under the influence of the cam 69.

To keep the center leaf 24 from rotating more than 90 degrees, the table has a pair of latches 79. Each latch 79 is positioned at the juncture of the left hand arm 64 and the leg 65 of the inverse "T" shaped slot 32 of the respective frame face member 30. Both latches 79 are the same. One latch 79 is shown in detail in FIGS. 7 and 8.

Figure 7:
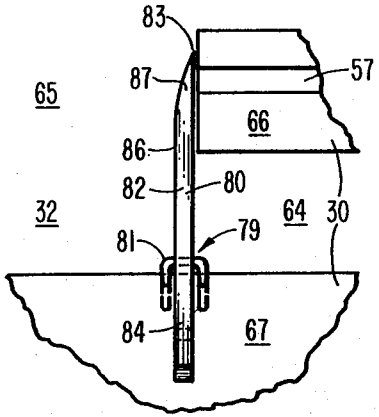
FIG. 7 is a detail front view of a latch of the table.
Figure 8:
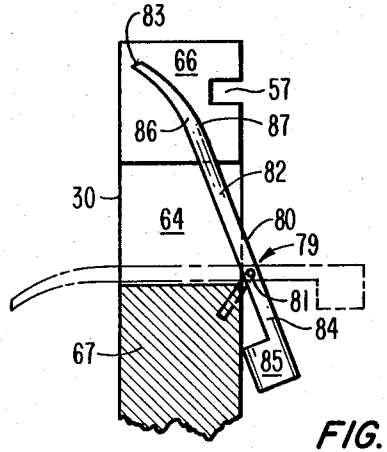
FIG. 8 is a detail side view of the latch of FIG. 7.

The latch 79 comprises of an elongated latch member 80 which is rotatably mounted on a shaft 81 to the inner upper edge of the body 67 of the "C"-shaped face member 30. The latch member 80 is rotatable in the plane of the cross-section of FIG. 6. The latch member 80 includes a top portion 82 which defines a knife edge 86 and a spine 87. The knife edge 86 of the top portion 82 of the latch member 80 is tapered to a point 83, as shown in FIG. 7. The taper of the knife edge 86 curves toward the adjacent claw 66 of the "C"-shaped face member 30. The bottom portion 84 of the latch member 80 is made heavy by the addition of a weight 85, shown in FIG. 8, to urge the bottom portion 84 downward and thereby to urge the whole latch member 80 into the upright position of FIG. 7. As shown in FIG. 8, the spine 87 of the top portion 82 of the latch member 80 is curved away from the adjacent channel 57 to prevent the upright latch member 80 from overlapping the channel 57 and to keep the point 83 of the latch member 80 pointing downward when the latch member 80 is in the horizontal position indicated by dashed lines in FIG. 8.

When the table 20 is in the configuration of FIGS. 3 and 4, the center leaf 24 lies over the latches 79, contacting the spines 87 and thereby keeping the latch members 80 in the horizontal position indicated by dashed lines in FIG. 8. As the center leaf 24 rotates clockwise, its side edges 44, 45 pass over the latches 79 and allow the latch members 80 to be brought into the upright position by the weights 85. As the center leaf 24 reaches the 90th degree of its rotation, its side edges 44, 45 come into contact with the knife edges 86 of the latches 79, and press each latch member 80 against the adjacent claw 66 of the "C"-shaped face member 30. Further rotation of the center leaf 24 is then blocked by the latches 79. As the pulley 46 continues to rotate, it pushes the inclined plane 68 under the roller 72 and forces the center leaf 24 to ride up, its edges 44, 45 riding the knife edges 86 of the latches 79.

Conversely, when the table 20 is in the configuration of FIGS. 1 and 2 and the pulley 46 is rotating counterclockwise, the leaf 24 has a tendency to rotate clockwise because gravity urges the rollers 72 to ride down the inclined planes 68 at a higher speed than the the rotation of the pulley 46 permits. But the leaf 24 is kept from rotating by the latches 79, which guide the center leaf 24 along their knife edges 86 substantially horizontally down unit the rollers 72 reach the top surface 74 of the pulley 46. At that point the center leaf 24 loses its gravitational impetus to rotate clockwise and begins to rotate counterclockwise with the pulley 46 away from the knife edges 86. As the center leaf 24 rotates further, its edges 44, 45 again come into contact with the spines 87 of the latches 79 and fold the latch members 80 under the center leaf 24, into the dashed position of FIG. 8.

Driving force is supplied to the mechanism 25 by a conventional motor drive 88, for example Model 2Z797 of the Dayton Electric MFG. Co., Chicago, IL. 66648, which rotates the pulley 46 by means of a V-belt 89. The gearing of the motor drive 88 is such that the pulley 47 is rotated relatively slowly, preferably on the order of 1 to 10 r.p.m. The motor drive 88 is mounted to the frame 28 in a corner of the frame 28 so as to be substantially hidden from outside view. Preferably, the motor drive 88 is packed in sound absorbing insulating material in order to quiet it.

Figure 12:
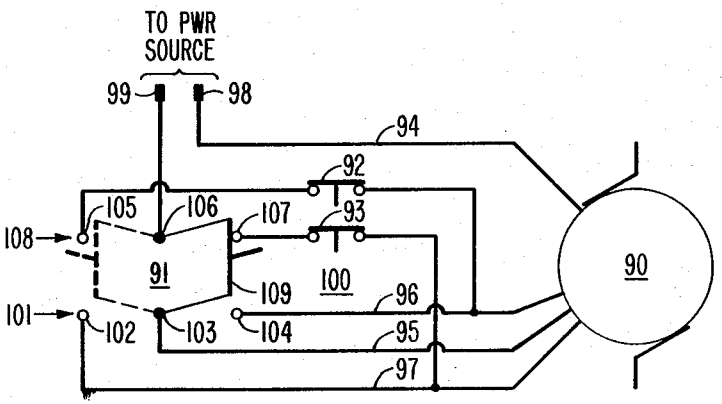
FIG. 12 is a schematic diagram of the switching circuit of the table.

The motor drive 88 includes a conventional reversible electric motor 90 which operates from a 60 Hz, 117 VAC power source, as shown in FIG. 12. The motor 90 has four electrical contact leads, herein designated as a common contact 94, a winding contact 95, a forward contact 96, and a reverse contact 97. The common contact 94 connects to a first terminal 98 of the AC power supply outlet.

When the winding contact 95 is connected to the forward contact 96, and a second AC power terminal 99 is connected to the reverse contact 97, the motor 90 rotates forward and drives the pulley 46 clockwise. When the winding contact 95 is connected to the reverse contact 97, and the second AC power terminal is connected to the forward contact 96, the motor 90 rotates in reverse and drives the pulley 46 counterclockwise.

Operation of the motor 90 is controlled by the switching circuit 100, shown schematically in FIG. 12, which establishes the above-described connections. A double-pole-double-throw toggle switch 91 starts the motor 90 rotating in the forward or reverse direction, depending on the position of the switch 91. The toggle switch 91 has a direction-switching pole 101 which comprises a reverse terminal 102, a winding terminal 103, and a forward terminal 104. The switch 91 also has a power switching pole 108 which comprises an "unfolded" terminal 105, a power terminal 106, and a "folded" terminal 107. A toggle member 109 of the switch 91 selectively assumes a first position, shown in solid lines in FIG. 12, in which it connects the terminal 103 with the terminal 104, and further connects the terminal 106 with the terminal 107, leaving the terminals 101 and 105 floating, and a second position, shown in dashed lines in FIG. 12, in which it connects the terminal 102 with the terminal 103, and further connects the terminal 105 with the terminal 106, leaving the terminals 104 and 107 floating.

On the side of the direction switching pole 101 in FIG. 12, the terminal 102 is connected to the contact 97, the terminal 103 is connected to the contact 95, and the terminal 104 is connected to the contact 96. On the side of the power switching pole 108, the terminal 105 is connected to one side of a "folded" switch 92, the other side of which is connected to the contact 96; the terminal 106 is connected to the AC power terminal 99; and the terminal 107 is connected to one side of an "unfolded" switch 93, the other side of which is connected to the contact 97. The switches 92 and 93 are normally-closed pushbutton switches.

When the toggle member 109 of the switch 91 is in the position shown in solid lines in FIG. 12, the AC power terminal is connected across the terminals 106 and 107 and across the "unfolded" switch 93 to the contact 97, and the winding contact 95 is connected across the terminals 103 and 104 to the contact 96, causing the motor 90 to rotate forward until the "unfolded" switch 93 is opened. When the switch 91 is toggled into the position shown in dashed lines in FIG. 12, the AC power terminal 99 is connected across the terminals 106 and 105 and across the "folded" switch 93 to the contact 96, and the winding contact 95 is connected across the terminals 103 and 102 to the contact 97, causing the motor 90 to rotate in reverse until the "folded" switch 92 is opened.

Figure 11:
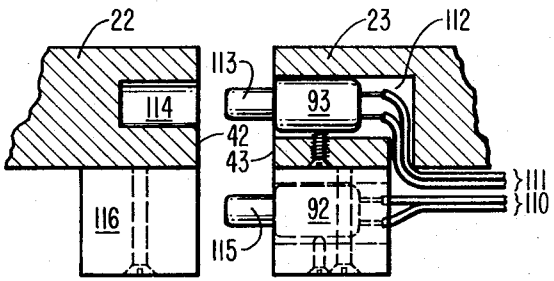
FIG. 11 is a detail view of a switch mounting arrangement of the table.

The switches 92 and 93 are mounted at the side edge 43 of the side leaf 23 (see FIGS. 1 and 3) for being automatically opened and closed upon the table having reached a desired configuration. The switches 92 and 93 are connected to the drive mechanism 88 and the switching circuit 100 by a pair of coiled spring line cords 110, 111. The details of the mounting of the switches 92 and 93 are shown in FIG. 11.

The "unfolded" switch 93 is mounted in a chamber 112 bored into the side leaf 23 and opening on its side edge 43. A pushbutton actuator 113 of the switch 93 extends horizontally outwardly from the chamber 112. Directly opposite from the switch 93 the side edge 42 of the side leaf 22 defines a chamber 114 which is adapted to receive the actuator 113 without opening the switch 93. The "folded" switch 92 is mounted to the lower surface of the side leaf 23. A push button actuator 115 of the switch 92 extends in parallel to the actuator 113 past the side edge 43 of the side leaf 23. Directly opposite the switch 92, a stopper 116 is mounted to the bottom surface of the side leaf 22. The actuator 115 is adapted to open the switch 92 upon contacting the stopper 116.

Thus, when the table 20 is in the configuration of FIGS. 3 and 4, with the side edges 42 and 43 of the side leaves 22 and 23, respectively, abutting each other, the actuator 113 of the switch 93 lies inside the chamber 114 and the switch 93 remains closed, but the actuator 115 of the switch 92 is depressed by the stopper 116 and the switch 92 is open. When the table 20 is in a transition state between the configurations of FIGS. 3, 4 and FIGS. 1, 2, both switches 92 and 93 are closed. And when the table 20 is in the configuration of FIGS. 1 and 2, with the side edges 43 and 45 of the side leaf 23 and the center leaf 24, respectively, abutting each other, the actuator 113 of the switch 93 is depressed by the side edge 45 of the center leaf 24 and the switch 93 is open, but the actuator 115 of the switch 92 extends below the center leaf 24 and the switch 92 remains closed.

The overall operation of the table 20 is as follows.

In the configuration of FIGS. 1 and 2, the switch 91 is in the position shown in solid lines in FIG. 12, but the switch 93 is open, and so the table 20 is in a quiescent state.

To reconfigure the table 20 into the configuration of FIGS. 3 and 4, the switch 91 is toggled into the position shown in dashed lines in FIG. 12, establishing a power connection to the motor 90 through the switch 92, and the motor 90 begins to turn in reverse. In response, the motor drive 88 rotates the pulley 46 counterclockwise. The pulley 46 pushes on the arms 59, causing the side leaves 22 and 23 to slide away from the center leaf 24, which causes the nipples 39 to disengage from the orifices 38 and the switch 93 to close. At this point the rollers 72 roll off of the flat tracks 70 onto the inclined tracks 71 and the center leaf 24 begins to travel downward along the cam 69, its side edges 44 and 45 tracing the knife edges 86 of the latches 79. Having rotated somewhat, the pulley 46 begins to pull on the arms 59, causing the side leaves 22 and 23 to slide toward each other over the top of the downwardly traveling center leaf 24. The rollers 72 reach the top surface 74 of the pulley 46 and the center leaf 24 begins to rotate counterclockwise with the pulley 46. After some degree of rotation, the side edges 44, 45 of the center leaf 24 recontact the latches 79, rotate them into the horizontal position shown in dashed lines in FIG. 8, and the center leaf 24 passes over the latches 79. When the center leaf 24 has rotated 90 degrees, the side edges 42, 43 of the side leaves 22, 23, respectively, come together and the nipples 39 of the side leaf 23 engage the orifices 38 of the side leaf 22. The stopper 116 pushes on the actuator 115 and the switch 92 opens, interrupting the power connection to the motor 90 and turning the motor drive 88 off. The pulley 46 stops rotating and the table 20 assumes the quiescent closed, or folded, state of FIGS. 3 and 4.

To now reconfigure the table 20 back into the configuration of FIGS. 1 and 2, the switch 91 is toggled into the position shown in solid lines in FIG. 12, establishing a power connection to the motor 90 through the switch 93, and the motor 90 begins to turn forward. In response, the motor drive 88 rotates the pulley 46 clockwise. The pulley pushes on the arms 59, causing the side leaves 22 and 23 to slide away from each other, which causes the nipples 39 of the side leaf 23 to disengage from the orifices 38 of the side leaf 22 and the switch 92 to close. Meanwhile, the center leaf 24 is rotating clockwise below the side leaves 22 and 23 along with the pulley 46. After some degree of rotation of the center leaf 24, the latches 79 pass out from under the center leaf 24 and assume their upright position shown in FIG. 7. After the center leaf 24 has rotated 90 degrees, the side edges 44, 45 of the center leaf 24 engage the latches 79, which prevent the center leaf 24 from rotating further, and the center leaf 24 begins to ride upward along the cam 69. The rollers 72 reach the flat tracks 70 substantially at the time that the side leaves 22, 23 are furthest apart, separated by a distance somewhat greater than W, and the arms 59 are in transition between pushing and pulling the side leaves 22, 23. As the pulley 46 rotates further, the arms 59 pull the side leaves 22, 23 toward the center leaf 24. As the center leaf 24 becomes interposed between the side leaves 22,23, the side edge 42 of the side leaf 22 comes to abut the side edge 44 of the center leaf 24, the side edge 43 of the side leaf 23 comes to abut the side edge 45 of the center leaf 24, and the nipples 39 engage the orifices 38. The side edge 45 depresses the actuator 113 and the switch 93 opens, interrupting the power connection to the motor 90 and turning the motor drive 88 off. The pulley 46 stops rotating and the table 20 assumes the open, unfolded, state of FIGS. 1 and 2.

Of course, it should be understood that various changes and modifications to the preferred embodiment described above will be apparent to those skilled in the art. For example, the shapes and sizes of the various components can be varied, the indicated directions of motion can be reversed upon a reversal of the involved components, or the toggle switch can be replaced with a remotely-actuated switch. These and other changes and modifications can be made without departing from the scope and spirit of the invention and without diminishing its attendant advantages. It is therefore intended that all such changes and modifications be covered by the following claims.

We claim:

1. An improved table comprising:

a pair of side leaves movable with respect to each other to abut each other for forming a tabletop of a first size;

a center leaf selectively interposable between the pair of side laves for forming therewith a tabletop of a second size; and moving means coupled to the pair of side leaves and the center leaf for selectively moving the side leaves into abutment with each other while at the same time lowering and rotating the center leaf to remove the center leaf from in between the side leaves, and for selectively separating the side leaves while at the same time rotating and raising the center leaf to interpose the center leaf between the pair of side leaves.

2. The apparatus of claim 1 wherein the moving means include a mechanism having slide means for sliding the side leaves toward and away from each other and cam means for raising and lowering and rotating the center leaf.

3. The apparatus of claim 1 wherein the moving means include a motor coupled to the moving mechanism for driving the moving mechanism.

4. An improved table comprising:

a pair of side leaves movable with respect to each other to abut each other for forming a tabletop of a first size, each side leaf defining a pair of runners on its underside;

a center leaf selectively interposable between the pair of side leaves for forming therewith a tabletop of a second size;

a table frame positioned below the pair of side leaves and comprising a pair of face members, each face member defining a pair of channels each of which is adapted to slidingly engage a runner of a side leaf, each face member further defining a slot adapted to receive the center leaf;

a rotatable member mounted to the frame and positioned below the center leaf, the rotatable member defining a plurality of inclined planes on its upper surface;

a plurality of rollers attached to the underside of the center leaf, each roller adapted to ride one of the plurality of the inclined planes for raising and lowering the center leaf out of and into the slots;

a pair of arms for pushing and pulling the side leaves, each arm attached at one end to the rotatable member and attached at the other end to one of the side leaves; and driving means for selectively rotating the rotatable member in a clockwise and a counterclockwise direction.

5. The apparatus of claim 4 wherein the center leaf is adapted to rotate with the rotatable member in the slot when the center leaf is lowered.

6. The apparatus of claim 5 further comprising at least one latch means mounted to the frame for selectively engaging the center leaf to prevent the center leaf from rotating.

7. The apparatus of claim 4 wherein the driving means include a reversible motor.

8. The apparatus of claim 4 further including switching means for selectively causing the driving means to rotate in the clockwise and the counterclockwise directions.

9. The apparatus of claim 4 further including switching means for disabling the driving means when a tabletop of a selected size is formed.

10. The apparatus of claim 4 further comprising means for keeping the center leaf properly positioned over the rotatable member.

* * * * *